US005833132A

United States Patent [19]

Bachmeier

[11] Patent Number: 5,833,132

[45] Date of Patent: Nov. 10, 1998

[54] SECURITY MAILBOX

[76] Inventor: Eugene N. Bachmeier, 27131 52nd Ave. South, Kent, Wash. 98032

[21] Appl. No.: 910,530

[22] Filed: Aug. 7, 1997

[51] Int. Cl.[6] ..... B65G 11/04

[52] U.S. Cl. ..... 232/47; 232/17; 232/43.1

[58] Field of Search ..... 232/17, 45, 43.1, 232/47, 29

[56] References Cited

U.S. PATENT DOCUMENTS

| | | | |
|---|---|---|---|
| D. 263,514 | 3/1982 | Paparella . | |
| 3,735,919 | 5/1973 | Morgan | 232/17 |
| 4,367,844 | 1/1983 | Drummond | 232/17 |
| 4,724,999 | 2/1988 | Fitzgerald et al. | 232/17 |
| 4,793,551 | 12/1988 | Baylor | 232/17 |
| 4,844,332 | 7/1989 | Long | 232/17 |
| 4,863,096 | 9/1989 | Thomas | 232/17 |
| 4,905,891 | 3/1990 | Wildish et al. | 232/17 |
| 4,993,626 | 2/1991 | Berry | 232/17 |
| 5,071,063 | 12/1991 | Overstreet | 232/17 |
| 5,096,115 | 3/1992 | Hassan | 232/43.1 X |
| 5,148,974 | 9/1992 | Clapper | 232/17 |
| 5,407,127 | 4/1995 | Worden | 232/17 |
| 5,435,484 | 7/1995 | Carlson | 232/47 |

*Primary Examiner*—Kenneth J. Dorner
*Assistant Examiner*—William L. Miller

[57] ABSTRACT

A long term mail storage device is provided including a lower extent with an access door hingably coupled thereto. A lock is associated therewith for allowing access within an interior space to only privileged users. An opening is formed in a top face of the lower extent. Further included is an upper extent having a bottom opening in communication with the opening of the lower extent. The upper extent has a bottom trap door hingably coupled thereto. Next provided is a trap door control assembly situated within the lower extent. During use, the trap door may be maintained in an upright orientation for allowing mail to drop within the interior space of the lower extent and further maintained in a lowered orientation for precluding mail from dropping within the interior space of the lower extent.

9 Claims, 2 Drawing Sheets

SECURITY MAILBOX

BACKGROUND OF THE INVENTION

1. Field of the Invention

The present invention relates to mailboxes and more particularly pertains to a new SECURITY MAILBOX for safely storing mail while a user is away.

2. Description of the Prior Art

The use of mailboxes is known in the prior art. More specifically, mailboxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art mailboxes include U.S. Pat. No. 5,435,484; U.S. Pat. No. 5,148,974; U.S. Pat. No. 4,993,626; U.S. Pat. No. 4,905,891; U.S. Pat. No. 5,096,115; and U.S. Pat. No. Des. 263,514.

In these respects, the SECURITY MAILBOX according to the present invention substantially departs from the conventional concepts and designs of the prior art, and in so doing provides an apparatus primarily developed for the purpose of safely storing mail while a user is away.

SUMMARY OF THE INVENTION

In view of the foregoing disadvantages inherent in the known types of mailboxes now present in the prior art, the present invention provides a new SECURITY MAILBOX construction wherein the same can be utilized for safely storing mail while a user is away.

The general purpose of the present invention, which will be described subsequently in greater detail, is to provide a new SECURITY MAILBOX apparatus and method which has many of the advantages of the mailboxes mentioned heretofore and many novel features that result in a new SECURITY MAILBOX which is not anticipated, rendered obvious, suggested, or even implied by any of the prior art mailboxes, either alone or in any combination thereof.

To attain this, the present invention generally comprises a lower extent with a rectilinear configuration. As shown in FIG. 1, the lower extent has a top face, a bottom face, a front face, a rear face and a pair of side faces situated therebetween defining an interior space. It should be noted that the faces of the lower extent are planar and rectangular. For supporting the lower extent above the ground, the lower extent has four legs coupled to the bottom face thereof which depend downwardly therefrom. A circular aperture is formed in the front face of the lower extent adjacent the top face and one of the side faces thereof. Such aperture is adapted for allowing the placement of newspapers within the interior space of the lower extent. FIG. 1 further shows an access door hingably coupled on the rear face of the lower extent with an associated lock. Such lock serves to allow access to the interior space to only privileged users by way of a key. For reasons that will become apparent hereinafter, the lower extent has a rectangular opening formed in the top face between the front and rear faces thereof. Preferably, the rectangular opening resides adjacent one of the side faces opposite the circular aperture. As best shown in FIG. 3, a baffle with a rectangular configuration has a linear side edge coupled to one of the side faces of the lower extent below the rectangular opening. The baffle extends downwardly and inwardly from its coupling with the lower extent. Lastly, the lower extent has a rectangular grate coupled to the bottom face thereof and residing in a plane skewed in relation to the bottom face thereof. Such grate functions to prevent moisture from accruing adjacent the mail rested thereon. Next provided is an intermediate extent having an open bottom in communication with the rectangular opening of the lower extent and an open top. The intermediate extent has a pair of parallelogram-shaped side faces. Coupled therebetween is a front face extending upwardly and forwardly with respect to the front face of the lower extent and a rear face extending upwardly and forwardly with respect to the rear face of the lower extent. Coupled over the open top of the intermediate extent is an upper extent. The upper extent thus has a bottom opening in communication with the open top of the intermediate extent. The upper extent has a pair of rectangular side walls, a rear wall, and an arcuate top wall defining a front opening. For permitting access to the upper extent, a mail door is hingably coupled over the front opening thereof with a pull tab. The pull tab serves to facilitate the opening and closing of the mail door during use. As is conventional in the art of personal mail boxes, a flag is hingably coupled to an inboard side wall of the upper extent. AS best shown in FIGS. 2 & 3, a bottom trap door is hingably coupled along a lower edge of the inboard side wall. To control the movement of the trap door, a trap door control assembly is provided. The trap door control assembly includes a rod having an elastomeric handle situated on a first end thereof and a second end with a hook-shaped configuration. The second end is pivotally coupled to a tab formed on a bottom of the trap door. By this structure, the trap door may be maintained in an upright orientation when the handle of the rod is set on the baffle. In such orientation, the trap door is adapted for allowing mail to drop within the interior space of the lower extent. The trap door may further be maintained in a lowered orientation when the handle of the rod is removed from the baffle for precluding mail from dropping within the interior space of the lower extent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new SECURITY MAILBOX apparatus and method which has many of the advantages of the mailboxes mentioned heretofore and many novel features that result in a new SECURITY MAILBOX which is not anticipated, rendered obvious, suggested, or even implied by any of the prior art mailboxes, either alone or in any combination thereof.

It is another object of the present invention to provide a new SECURITY MAILBOX which may be easily and efficiently manufactured and marketed.

It is a further object of the present invention to provide a new SECURITY MAILBOX which is of a durable and reliable construction.

An even further object of the present invention is to provide a new SECURITY MAILBOX which is susceptible of a low cost of manufacture with regard to both materials and labor, and which accordingly is then susceptible of low prices of sale to the consuming public, thereby making such SECURITY MAILBOX economically available to the buying public.

Still yet another object of the present invention is to provide a new SECURITY MAILBOX which provides in the apparatuses and methods of the prior art some of the advantages thereof, while simultaneously overcoming some of the disadvantages normally associated therewith.

Still another object of the present invention is to provide a new SECURITY MAILBOX for safely storing mail while a user is away.

Even still another object of the present invention is to provide a new SECURITY MAILBOX that includes a lower extent with an access door hingably coupled thereto. A lock is associated therewith for allowing access within an interior space to only privileged users. An opening is formed in a top face of the lower extent. Further included is an upper extent having a bottom opening in communication with the opening of the lower extent. The upper extent has a bottom trap door hingably coupled thereto. Next provided is a trap door control assembly situated within the lower extent. During use, the trap door may be maintained in an upright orientation for allowing mail to drop within the interior space of the lower extent and further maintained in a lowered orientation for precluding mail from dropping within the interior space of the lower extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
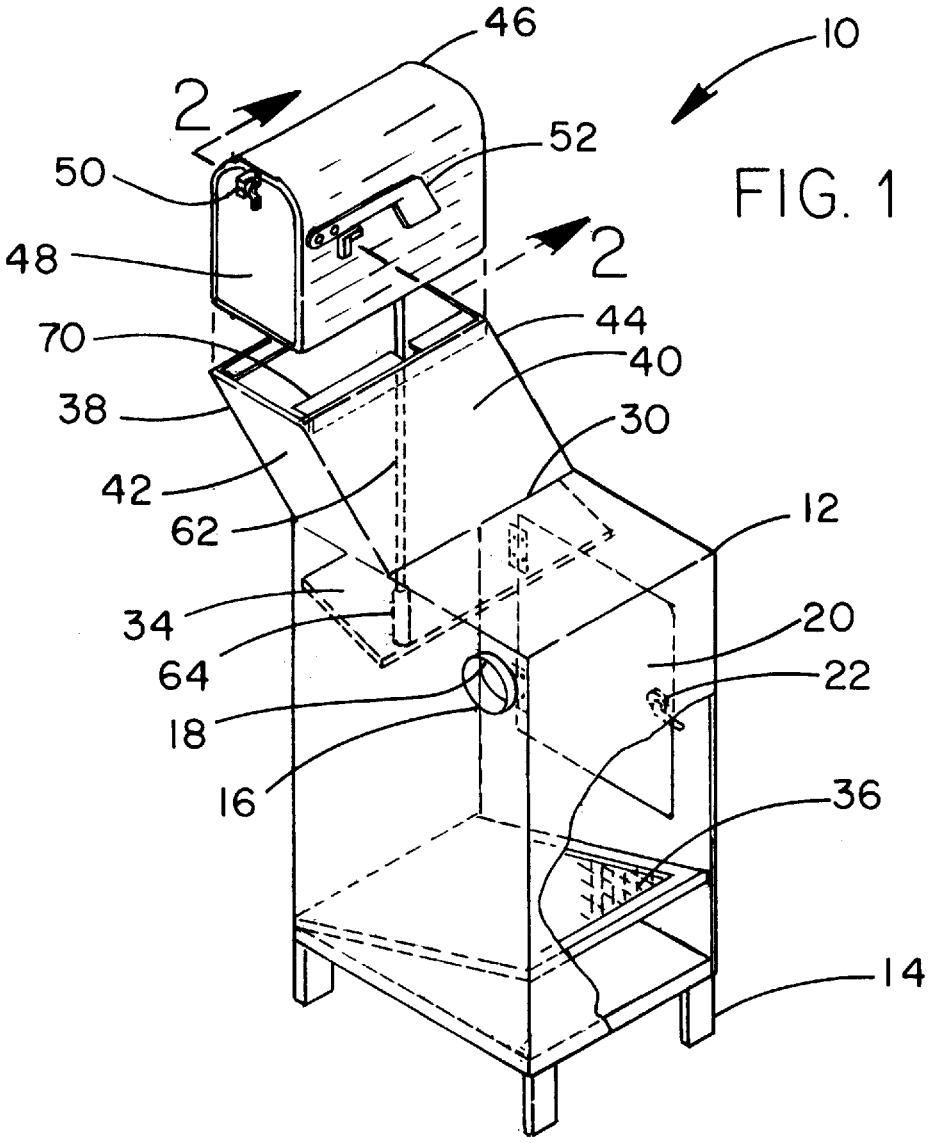
FIG. 1 is a perspective view of a new SECURITY MAILBOX according to the present invention.
Figure 2:
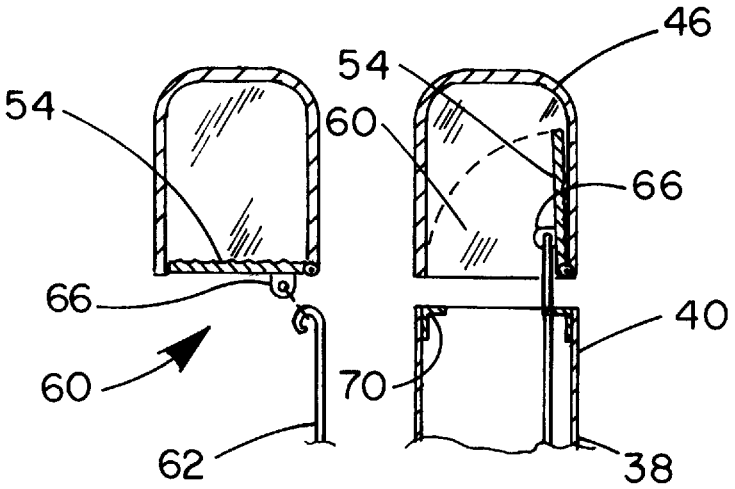
FIG. 2 is a front cross-sectional view of the upper extent of the present invention taken along line 2—2 shown in FIG. 1.
Figure 3:
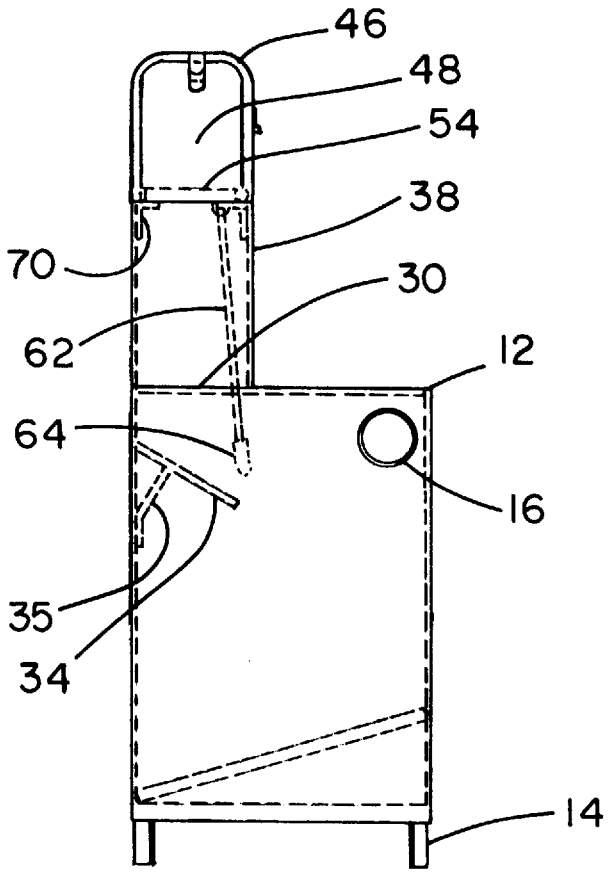
FIG. 3 is a front view of the present invention.

With reference now to the drawings, and in particular to FIGS. 1 through 3 thereof, a new SECURITY MAILBOX embodying the principles and concepts of the present invention and generally designated by the reference numeral 10 will be described.

The system of the present invention designated as numeral 10 includes a lower extent 12 with a rectilinear configuration. As shown in FIG. 1, the lower extent has a top face, a bottom face, a front face, a rear face and a pair of side faces situated therebetween defining an interior space. It should be noted that the faces of the lower extent are planar and rectangular. For supporting the lower extent above the ground, the lower extent has four legs 14 coupled to the bottom face thereof which depend downwardly therefrom. A circular aperture 16 is formed in the front face of the lower extent adjacent the top face and one of the side faces thereof. Such aperture is adapted for allowing the placement of newspapers within the interior space of the lower extent. To prevent rain from entering the lower extent, an awning 18 extends from a top edge of the circular aperture. FIG. 1 further shows an access door 20 hingably coupled on the rear face of the lower extent with an associated lock 22. Such lock serves to allow access to the interior space only to privileged users by way of a key. In the preferred embodiment, the door has an area at least half that of the rear face of the lower extent.

For reasons that will become apparent hereinafter, the lower extent has a rectangular opening 30 formed in the top face between the front and rear faces thereof. Preferably, the rectangular opening resides adjacent one of the side faces opposite the circular aperture. As best shown in FIG. 3, a baffle 34 with a rectangular configuration has a linear side edge coupled to one of the side faces of the lower extent below the rectangular opening. The baffle extends downwardly and inwardly from its coupling with the lower extent. Ideally, the baffle extends inwardly a distance no more than the width of the rectangular opening. Further, a truss 35 is suitably coupled between a bottom of the baffle and the side face of the lower extent for support purposes.

The lower extent finally has a rectangular grate 36 coupled to the bottom face thereof and residing in a plane skewed in relation to the bottom face thereof. Such grate functions to prevent moisture from accruing adjacent the mail rested thereon. Preferably, an incline of at least 10 degrees is employed.

Next provided is an intermediate extent 38 having an open bottom in communication with the rectangular opening of the lower extent. The intermediate extent further has an open top. The intermediate extent has a pair of parallelogram-shaped side faces 40 coupled to the top face of the lower extent. Coupled between the side faces is a front face 42 extending upwardly and forwardly with respect to the front face of the lower extent and a rear face 44 extending upwardly and forwardly with respect to the rear face of the lower extent.

Coupled over the open top of the intermediate extent is an upper extent 46. The upper extent has a bottom opening in communication with the open top of the intermediate extent. The upper extent further has a pair of rectangular side walls, a rear wall, and an arcuate top wall all coupled to an upper peripheral edge of the intermediate extent thereby defining a front opening. For permitting access to the upper extent, a mail door 48 is hingably coupled over the front opening of the upper extent with a pull tab 50. The pull tab 50 serves to facilitate the opening and closing of the mail door during use. As is conventional in the art of personal mail boxes, a flag 52 is hingably coupled to an inboard side wall of the upper extent. As best shown in FIGS. 2 & 3, a bottom trap door 54 is hingably coupled along a lower edge of the inboard side wall. In the preferred embodiment, the trap door has a size equal to that of the open top of the intermediate extent.

To control the movement of the trap door, a trap door control assembly 60 is provided. The trap door control assembly includes a rod 62 having an elastomeric handle 64 situated on a first end thereof and a second end with a hook-shaped configuration. The second end is pivotally coupled to a tab 66 formed on a bottom of the trap door. By this structure, the trap door may be maintained in an upright orientation when the handle of the rod is set on the baffle. In such orientation, the trap door is adapted for allowing mail to drop within the interior space of the lower extent. The trap door may further be maintained in a lowered orientation when the handle of the rod is removed from the baffle for precluding mail from dropping within the interior space of the lower extent. When in the lowered orientation, the rod swings freely adjacent the baffle and the trap door is prevented from lowering below the horizontal by way of a plurality of lips 70 formed on the peripheral edge of the open top of the intermediate extent. As shown in FIG. 1, a gap is formed in one of the lips 70 for allowing the passage of the rod.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A long term mail storage device comprising, in combination:

a lower extent with a rectilinear configuration having a top face, a bottom face, a front face, a rear face and a pair of side faces situated therebetween defining an interior space, the faces of the lower extent being planar and rectangular, the lower extent having four legs coupled to the bottom face thereof and depending downwardly therefrom for supporting the lower extent above the ground, a circular aperture formed in the front face of the lower extent adjacent the top face and one of the side faces thereof for allowing the placement of newspapers within the interior space of the lower extent, an access door hingably coupled on the rear face of the lower extent with an associated lock for allowing access to the interior space to only privileged users, a rectangular opening formed in the top face of the lower extent between the front and rear faces thereof adjacent one of the side faces opposite the circular aperture, a baffle with a rectangular configuration having a linear side edge coupled to one of the side faces of the lower extent below the rectangular opening and extending downwardly and inwardly therefrom, and a rectangular grate coupled to the bottom face of the lower extent and residing in a plane skewed in relation to the bottom face thereof;

an intermediate extent having an open bottom in communication with the rectangular opening of the lower extent and an open top, the intermediate extent further having a pair of parallelogram-shaped side faces, a front face extending upwardly and forwardly with respect to the front face of the lower extent, and a rear face extending upwardly and forwardly with respect to the rear face of the lower extent;

an upper extent having a bottom opening in communication with the open top of the intermediate extent, the upper extent having a pair of rectangular side walls, a rear wall, and an arcuate top wall defining a front opening, the upper extent having a mail door hingably coupled over the front opening thereof with a pull tab for allowing the opening and closing thereof during use, a flag hingably coupled to an inboard side wall of the upper extent, and a bottom trap door hingably coupled along a lower edge of the inboard side wall; and a trap door control assembly including a rod having an elastomeric handle situated on a first end thereof and a second end with a hook-shaped configuration, the second end pivotally coupled to a tab formed on a bottom of the trap door, whereby the trap door may be maintained in an upright orientation when the handle of the rod is set on the baffle for allowing mail to drop within the interior space of the lower extent and further maintained in a lowered orientation when the handle of the rod is removed from the baffle for precluding mail from dropping within the interior space of the lower extent.

2. A long term mail storage device comprising:

a lower extent including an access door hingably coupled thereto with an associated lock for allowing access to an interior space to only privileged users, an opening formed in a top face of the lower extent;

an upper extent having a bottom opening in communication with the opening of the lower extent, the upper extent having a bottom trap door hingably coupled thereto for allowing mail to pass to the lower extent; and a trap door control assembly situated within the lower extent, whereby the trap door may be maintained in a first orientation for allowing mail to drop within the interior space of the lower extent and further maintained in a second orientation for precluding mail from dropping within the interior space of the lower extent;

wherein the trap door control assembly includes a rod pivotally coupled to a bottom of the trap door.

3. A long term mail storage device as set forth in claim 2 wherein an intermediate extent is situated between the upper and lower extent for allowing communication therebetween, the intermediate extent having a pair of parallelogram-shaped side faces, a front face extending upwardly and forwardly with respect to a front face of the lower extent, and a rear face extending upwardly and forwardly with respect to a rear face of the lower extent.

4. A long term mail storage device as set forth in claim 2 wherein the upper extent has a mail door hingably coupled over a front opening thereof with a pull tab for allowing the opening and closing thereof during use.

5. A long term mail storage device as set forth in claim 2 wherein the upper extent has a flag hingably coupled to an inboard side wall of the upper extent.

6. A long term mail storage device as set forth in claim 2 wherein the lower extent has four legs coupled to a bottom face thereof and depending downwardly therefrom for supporting the lower extent above the ground.

7. A long term mail storage device as set forth in claim 2 wherein the lower extent has a circular aperture formed in a front face of the lower extent for allowing the placement of newspapers therein.

8. A long term mail storage device as set forth in claim 2 wherein the lower extent has a baffle with a side edge coupled to a side face of the lower extent below the opening and extending downwardly and inwardly therefrom.

9. A long term mail storage device as set forth in claim 2 wherein the lower extent has a rectangular grate coupled to a bottom face, wherein the grate resides in a plane separated from the bottom face of the lower extent.

* * * * *